US010060654B2

(12) United States Patent
Takayama et al.

(10) Patent No.: US 10,060,654 B2
(45) Date of Patent: Aug. 28, 2018

(54) HEAT PUMP TYPE HEATING APPARATUS

(71) Applicant: SANDEN HOLDINGS CORPORATION, Isesaki-shi (JP)

(72) Inventors: Yasunori Takayama, Isesaki (JP); Hiroshi Ishida, Isesaki (JP); Masato Sakai, Isesaki (JP); Yoichi Negishi, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 0 days.

(21) Appl. No.: 15/519,396

(22) PCT Filed: Jul. 2, 2015

(86) PCT No.: PCT/JP2015/069188
§ 371 (c)(1),
(2) Date: Apr. 14, 2017

(87) PCT Pub. No.: WO2016/059837
PCT Pub. Date: Apr. 21, 2016

(65) Prior Publication Data

US 2017/0227260 A1 Aug. 10, 2017

(30) Foreign Application Priority Data

Oct. 16, 2014 (JP) ..... 2014-211969

(51) Int. Cl.
*F25B 7/00* (2006.01)

(52) U.S. Cl.
CPC ..... *F25B 7/00* (2013.01)

(58) Field of Classification Search
CPC .... F25B 7/00; F25B 9/02; F25B 30/02; F25B 6/04; F25B 9/008; F25B 49/022;
(Continued)

(56) References Cited

U.S. PATENT DOCUMENTS 4,484,449 A * 11/1984 Muench ..... F25B 7/00 318/112
4,916,913 A * 4/1990 Narikiyo ..... F24F 3/001 62/81

(Continued)

FOREIGN PATENT DOCUMENTS

EP 2 420 760 2/2012
JP H 10955/1993 2/1993

(Continued)

*Primary Examiner* — Mohammad M Ali
(74) *Attorney, Agent, or Firm* — Cozen O'Connor

(57) ABSTRACT

Heat pump type heating apparatus capable of performing a continuous dual-stage operation without stopping a high stage side compressor even when a return temperature of a heating medium reaches a prescribed high temperature and, thereby, improving a sense of being insufficiently warmed due to stoppage of the high stage side compressor or a sense of being insufficiently warmed due to execution of frequent defrosting operations. The heat pump type heating apparatus includes an internal heat exchanger (a second internal heat exchanger) that performs heat exchange between a low-temperature refrigerant on a low-pressure side of a low stage side refrigeration circuit and a high-temperature refrigerant on a high-pressure side of a high stage side refrigerant circuit, a bypass pipe bypassing the internal heat exchanger, and flow path control means that controls a refrigerant flow to each of the internal heat exchanger and the bypass pipe.

5 Claims, 10 Drawing Sheets

(58) Field of Classification Search
CPC ..... F25B 41/04; F25B 40/04; F25B 47/022; F25D 3/18
USPC ..... 62/175
See application file for complete search history.

(56) References Cited

U.S. PATENT DOCUMENTS

| | | | | |
|---|---|---|---|---|
| 5,095,712 | A * | 3/1992 | Narreau | F25B 1/10 62/113 |
| 6,212,898 | B1 * | 4/2001 | Ueno | A47F 3/04 62/335 |
| 2007/0193290 | A1 * | 8/2007 | Ebara | B60H 1/00885 62/238.6 |
| 2012/0204596 | A1 * | 8/2012 | Takenaka | F25B 6/04 62/510 |
| 2013/0227979 | A1 | 9/2013 | Kasuka | |

FOREIGN PATENT DOCUMENTS

| | | |
|---|---|---|
| JP | 2010-236816 | 10/2010 |
| JP | 2011-117685 | 6/2011 |
| JP | 2012-97993 | 5/2012 |

* cited by examiner

HEAT PUMP TYPE HEATING APPARATUS

RELATED APPLICATIONS

This is a U.S. National Phase Application under 35 USC 371 of International Application PCT/JP2015/069188 filed on Jul. 02, 2015.

This application claims the priority of Japanese application no. 2014-211969 filed Oct. 16, 2014, the entire content of which is hereby incorporated by reference.

TECHNICAL FIELD

The present invention relates to a heat pump type heating apparatus, particularly, using a dual-stage compression type heat pump unit.

BACKGROUND ART

Conventionally, a heat pump type heating apparatus of this type has generated hot water to be used for heating, by using, as a heat pump unit, a refrigeration circuit through which a refrigerant circulates. For example, a heat pump type heating apparatus disclosed in Patent Literature 1 includes: a heating unit that causes a heating medium to circulate into a heating terminal; a first stage side heat pump unit in which a refrigerant circulates through a first compressor, a first heat exchanger, a cascade heat exchanger, a first expansion valve, and an evaporator, in order, and exchanges, at the first heat exchanger, heat with the heating medium of the heating unit; and a second heat pump unit, in which a refrigerant circulates through a second compressor, a second heat exchanger, a second expansion valve, and the cascade heat exchanger, in order, and exchanges, at the second heat exchanger, heat with the heating medium of the heating unit.

A conventional heat pump type heating apparatus including first and second stage side heat pump units, as disclosed in Patent Literature 1, performs control of shifts among a single-stage operation in which a first stage (low stage side) compressor is operated and a second stage (high stage side) compressor is stopped, a dual-stage operation in which both the first compressor and the second compressor are operated, and a standby operation in which both the first compressor and the second compressor are stopped, on the basis of the temperature (a return heating-medium temperature) of a return heating medium flowed out of a heating terminal.

For example, when, in the single-stage operation, the current temperature of a return heating medium falls below a prescribed low temperature threshold, the operation is shifted to the dual-stage operation by additionally starting the second compressor. When, in the dual-stage operation, the current temperature of the return heating medium exceeds a prescribed high temperature threshold, the operation is shifted to the single-stage operation by stopping the second compressor. When, in the single-stage operation, the current temperature of the return heating medium again exceeds the prescribed high temperature threshold, the operation is shifted to the standby operation by additionally stopping the first compressor.

In this way, the conventional heat pump type heating apparatus has determined the insufficient heating performance of the heating terminal on the basis of the return temperature of the heating medium flowed out of the heating terminal, shifted the operation among the single-stage operation, the dual-stage operation, and the standby operation, and thereby, tried to achieve an efficient heating operation.

CITATION LIST

Patent Literature

[Patent Literature 1] Japanese Patent Laid-Open No. 2012-97993

SUMMARY OF INVENTION

Technical Problem

As described above, in the conventional heat pump type heating apparatus, as the return temperature of the heating medium is increased by execution of the dual-stage operation, a heat exchanger at which heat exchange is performed between a refrigerant of the second stage side (high stage side) refrigerant circuit and a heating medium of the heating unit, cannot reduce the temperature of a refrigerant discharged from the second compressor. In this case, the temperature or pressure of a refrigerant to be sucked into the second compressor abnormally increases to deviate from a suction temperature range or suction pressure range for securing appropriate usage of the compressor. Accordingly, in the conventional apparatus, a return temperature of the heating medium at which the suction temperature or suction pressure of the second compressor does not deviate from an appropriate range for use is set as a temperature for stopping the compressor.

However, under the condition of a low outside air temperature, when the dual-stage operation is switched to the single-stage operation to operate only the first stage side (low stage side) heat pump unit, the heating performance becomes insufficient soon. This leads to sudden decrease of the return temperature of the heating medium, and thus, the single-stage operation needs to be quickly switched to the dual-stage operation. Even in such a case, in order to avoid frequent start/stop of the compressor, the compressor cannot restart to operate until a prescribed time has been elapsed after being stopped. Therefore, even in a case where the outside air temperature is low and higher heating performance is required, the second compressor cannot quickly restart to operate. This results in temperature decrease in a space being heated, and causes a sense of being insufficiently warmed. In addition, when the second compressor is suspended, a prescribed time is required to stabilize the operation state after restart of the operation. Thus, problems of temperature decrease in a space being heated and the sense of being insufficiently warmed are difficult to solve soon after the restart of the operation.

Moreover, in the aforementioned conventional heat pump type heating apparatus, hot water for the heating unit is generated by the evaporator on the first stage side (low stage side) heat pump unit collecting heat from the outside air. Accordingly, during operation of the heat pump type heating apparatus, frost is formed in the first stage side evaporator, the temperature of which is lowered. Since frost formed in the evaporator causes degradation in heating performance of the heat pump type heating apparatus, a defrosting operation for melting frost sticking to the evaporator is performed. For example, the defrosting operation is performed by detecting the temperature of a refrigerant flowing into the evaporator, determining that frost has been formed when the temperature has fallen below a prescribed threshold, and, for example, fully opening the first expansion valve to cause hot gas to flow directly into the evaporator.

However, formation of frost in the evaporator is likely to occur under a condition of high humidity so that a defrosting operation is frequently performed. Since hot water having a high temperature cannot be supplied to the heating terminal during the defrosting operation, the problem of a sense of being insufficiently warmed arises.

Therefore, a market has demanded development of a heat pump type heating apparatus capable of performing a continuous dual-stage operation even when a return temperature of a heating medium reaches a prescribed high temperature, and thereby, improving a sense of insufficiently being warmed due to stop of a second compressor. Further, development of a heat pump type heating apparatus capable of improving a sense of insufficiently being warmed due to frequent defrosting operation has been also demanded.

Solution to Problem

Therefore, as a result of carrying out intensive and extensive researches, the present inventors have arrived at providing a heat pump type heating apparatus capable of performing a continuous dual-stage operation without stopping a high stage side compressor even when a return temperature of a heating medium reaches a prescribed high temperature, and thereby, improving a sense of being insufficiently warmed due to stop of the high stage side compressor or a sense of being insufficiently warmed due to execution of frequent defrosting operation.

That is, a heat pump type heating apparatus according to the present invention includes: a dual-stage heat pump unit including a low stage side refrigeration circuit formed by annularly connecting, in order, a low stage side compressor, a low stage side heating medium-refrigerant heat exchanger, a cascade heat exchanger, low stage side decompressing means, and an evaporator, so as to circulate a refrigerant therethrough, and a high stage side refrigeration circuit formed by annularly connecting, in order, a high stage side compressor, a high stage side heating medium-refrigerant heat exchanger, high stage side decompressing means, and the cascade heat exchanger, so as to circulate a refrigerant therethrough; and a heating unit having a heating medium circuit including a circulation pump, a heating terminal, the low stage side heating medium-refrigerant heat exchanger, and the high stage side heating medium-refrigerant heat exchanger, so as to circulate a heating medium therethrough, wherein the heat pump type heating apparatus further includes an internal heat exchanger that performs heat exchange between a low-temperature refrigerant on a low-pressure side of the low stage side refrigeration circuit and a high-temperature refrigerant on a high-pressure side of the high stage side refrigeration circuit, a bypass pipe bypassing the internal heat exchanger, and flow path control means that controls a refrigerant flow to each of the internal heat exchanger and the bypass pipe.

Furthermore, in the heat pump type heating apparatus according to the present invention, it is preferable that the bypass pipe is provided between a refrigerant flowout side of the high stage side heating medium-refrigerant heat exchanger and a refrigerant inflow side of the high stage side decompressing means in the high stage side refrigeration circuit, or between a refrigerant flowout side of the evaporator and a refrigerant suction side of the low stage side compressor in the low stage side refrigeration circuit.

Moreover, in the heat pump type heating apparatus according to the present invention, it is preferable that when, in a dual-stage operation in which the low stage side compressor and the high stage side compressor are operated, a return temperature of a heating medium flowed out of the heating terminal is equal to or higher than a prescribed high-temperature threshold, the flow path control means performs high stage side refrigerant cooling control of causing a refrigerant on the low-pressure side of the low stage side refrigeration circuit or a refrigerant on the high-pressure side of the high stage side refrigeration circuit to flow into the internal heat exchanger side.

Furthermore, in the heat pump type heating apparatus according to the present invention, it is preferable that the flow path control means performs the high stage side refrigerant cooling control when the outside air temperature is equal to or lower than a prescribed high stage side cooling operation upper limit temperature.

Moreover, in the heat pump type heating apparatus according to the present invention, it is preferable that the flow path control means performs the high stage side refrigerant cooling control when the outside air temperature is within a prescribed frequent defrosting operation temperature range.

Advantage Effects of Invention

The heat pump type heating apparatus according to the present invention includes the internal heat exchanger that performs heat exchange between a refrigerant on the low-pressure side of the low stage side refrigeration circuit and a refrigerant on the high-pressure side of the high stage side refrigerant circuit, the bypass pipe bypassing the internal heat exchanger, and the flow path control means that controls a refrigerant flow to each of the internal heat exchanger and the bypass pipe. Accordingly, when the return temperature of a heating medium flowed out of the heating terminal becomes higher than the prescribed high-temperature threshold in the dual-stage operation in which both the low stage side compressor and the high stage side compressor are operated, the high stage side refrigerant cooling control can be performed in which heat exchange is performed, at the internal heat exchanger, between a low-temperature refrigerant on the low-pressure side of the low stage side refrigeration circuit and a high-temperature refrigerant on the high-pressure side of the high stage side refrigeration circuit.

Accordingly, the temperature of the refrigerant on the high-pressure side of the high stage side refrigeration circuit can be reduced, and thereby, the temperature or pressure of the refrigerant to be sucked into the high stage side compressor can be reduced. For this reason, even when the return temperature of the heating medium reaches such a temperature as to make a continuous operation of a compressor impossible in a conventional apparatus, the suction temperature or suction pressure of the high stage side compressor can fall within an appropriate range for use and the dual-stage operation can be continued until a higher return temperature of the heating medium is reached.

Therefore, since a shift from the dual-stage operation to the single-stage operation in which only the low stage side compressor is operated can be suppressed to the utmost, it is possible to avoid in advance temperature decrease in a space being heated or generation of a sense of being insufficiently warmed, due to suspension of the high stage side compressor.

Furthermore, in the heat pump type heating apparatus according to the preset invention, when the outside air temperature is equal to or lower than the prescribed high stage side cooling operation upper limit temperature, the flow path control means switches the flow of a refrigerant on the low-pressure side of the low stage side refrigeration circuit or a refrigerant on the high-pressure side of the high stage side refrigeration circuit, from the flow to the bypass pipe side to the flow to the internal heat exchanger side. Accordingly, abnormal increase in suction temperature and suction pressure of the low stage side compressor is suppressed, and the dual-stage operation can be continued.

DESCRIPTION OF EMBODIMENT

Figure 1:
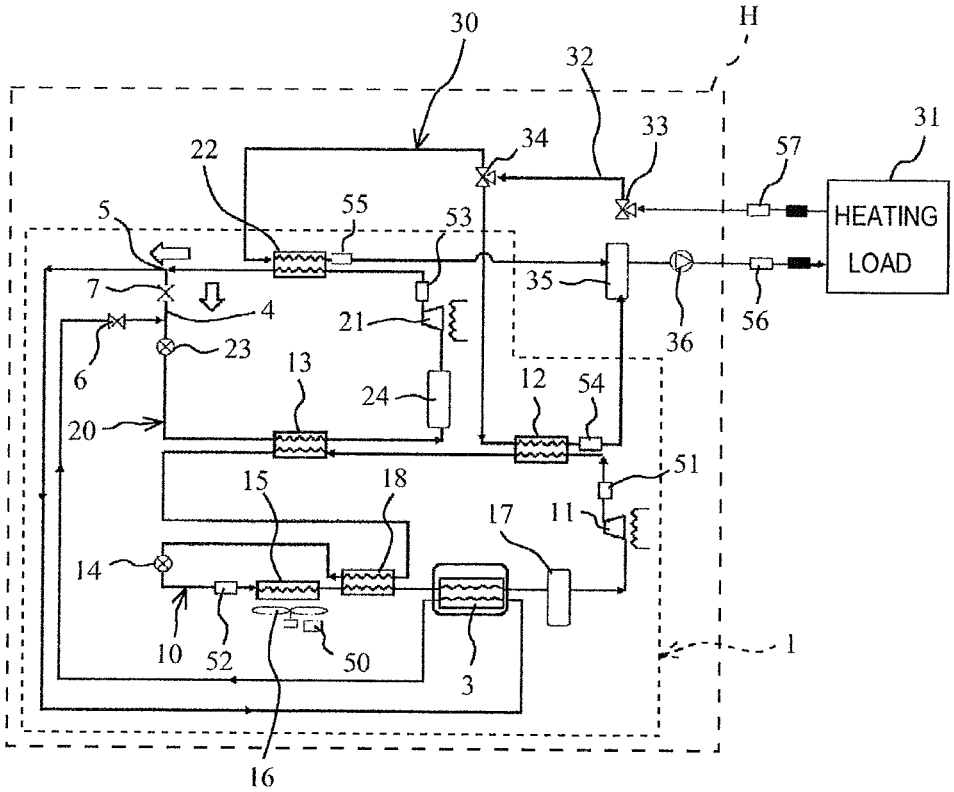
FIG. 1 is a schematic configuration diagram of a heat pump type heating apparatus as an embodiment of the present invention.

Hereinafter, a heat pump type heating apparatus H as an embodiment of the present invention will be described with reference to the drawings. FIG. 1 is a schematic configuration diagram of the heat pump type heating apparatus H as the present embodiment. The heat pump type heating apparatus H of the present embodiment according to the present invention includes a dual-stage heat pump unit 1 including a low stage side unit having a low stage side refrigeration circuit 10 and a high stage side unit having a high stage side refrigeration circuit 20, and includes a heating unit 30.

The low stage side refrigeration circuit 10 included in the low stage side unit is formed by annularly piping-connecting, in order, a low stage side compressor 11, a low stage side heating medium-refrigerant heat exchanger 12, a cascade heat exchanger 13, a low stage side expansion valve 14 serving as low stage side decompressing means, an evaporator 15, and an accumulator 17, and a prescribed amount of a refrigerant for circulating through the refrigeration circuit 10 is sealed therein.

The low stage side heating medium-refrigerant heat exchanger 12 is configured such that heat exchange can be performed between a high-temperature refrigerant flowing through the high-pressure side of the low stage side refrigeration circuit 10 and hot water (water) serving as a heating medium flowing within a heating medium circuit 32 included in the heating unit 30. The cascade heat exchanger 13 is configured such that heat exchange can be performed between a refrigerant flowing between the low stage side heating medium-refrigerant heat exchanger 12 and the low stage side expansion valve 14 in the low stage side refrigeration circuit 10 and a refrigerant flowing between a high stage side expansion valve 23 and a suction side of a high stage side compressor 21 in the high stage side refrigeration circuit 20. The evaporator 15 adopts an air cooling system of evaporating a refrigerant by taking heat from air passed through an evaporator blower 16 that is provided near the evaporator 15.

In addition, in the present embodiment, a first internal heat exchanger 18 is provided which performs heat exchange between a refrigerant flowing between the low stage side heating medium-refrigerant heat exchanger 12 and the low stage side expansion valve 14 and a refrigerant flowing between the evaporator 15 and a suction side of the low stage side compressor 11.

On the other hand, the high stage side refrigeration circuit 20 included in the high stage side unit is formed by annularly piping-connecting, in order, the high stage side compressor 21, a high stage side heating medium-refrigerant heat exchanger 22, the high stage side expansion valve 23 serving as high stage side decompressing means, the aforementioned cascade heat exchanger 13, and an accumulator 24, and a prescribed amount of a refrigerant for circulating through the refrigerant circuit is sealed therein. For example, carbon dioxide is preferably used as the refrigerants to be sealed in the low stage side refrigeration circuit 10 and the high stage side refrigeration circuit 20. However, refrigerants used in the heat pump type heating apparatus according to the present invention are not limited to carbon dioxide, and any refrigerant can be used.

The aforementioned high stage side heating medium-refrigerant heat exchanger 22 is configured such that heat exchange can be performed between a high temperature refrigerant flowing through the high-pressure side of the high stage side refrigeration circuit 20 and hot water (water) serving as a heating medium flowing within the heating medium circuit 32 included in the heating unit 30.

In addition to the aforementioned low stage side refrigeration circuit 10 and the high stage side refrigeration circuit 20, the heat pump type heating apparatus H according to the present invention is characterized by further including a second internal heat exchanger (an internal heat exchanger of the invention of the present application) 3 capable of performing heat exchange between a low-temperature refrigerant flowing through the low-pressure side of the low stage side refrigeration circuit 10 and a high-temperature refrigerant flowing through the high-pressure side of the high stage side refrigeration circuit 20, a bypass pipe 4 bypassing the second internal heat exchanger 3, and flow path control means that controls a refrigerant flow to each of the second internal heat exchanger 3 and the bypass pipe 4.

In the present embodiment, a three-way pipe 5 is connected to a refrigerant flowout side of the high stage side heating medium-refrigerant heat exchanger 22 of the high stage side refrigeration circuit 20, and the second internal heat exchanger 3 is connected to one of refrigerant flowout sides of the three-way pipe 5. The refrigerant flowout side of the second internal heat exchanger 3 of the high stage side refrigeration circuit 20 is connected to the refrigerant inflow side of the high stage side expansion valve 23 of the high stage side refrigeration circuit 20. An electromagnetic open/close valve (valve device) 6 that controls a refrigerant flow to the second internal heat exchanger 3 is interposed at the refrigerant flowout side of the second internal heat exchanger 3. Although the electromagnetic open/close valve is provided at the refrigerant flowout side of the second internal heat exchanger 3 in the present embodiment, the present invention is not limited this configuration. An electromagnetic valve may be provided at the refrigerant inflow side of the second internal heat exchanger 3.

The bypass pipe 4 bypassing the second internal heat exchanger 3 is connected to the other refrigerant flowout side of the three-way pipe 5. An electromagnetic open/close valve 7 that controls a refrigerant flow to the bypass pipe 4 is interposed in the bypass pipe 4. The refrigerant flowout side of the bypass pipe 4 is connected to the refrigerant inflow side of the high stage side expansion valve 23 of the high stage side refrigeration circuit 20.

Valve devices such as the electromagnetic open/close valve 6 that controls the refrigerant flow to the second internal heat exchanger 3 and the electromagnetic open/close valve 7 that controls the refrigerant flow to the bypass pipe 4 are included, together with a control device 2 (described in detail later) serving as control means, in flow path control means of the present invention. In the present invention, valve devices included in the flow path control means are not limited to the aforementioned valve devices, and any valve device may be used as long as the valve device can control the refrigerant flows to the second internal heat exchanger 3 and the bypass pipe 4 bypassing the second internal heat exchanger 3. For example, the three-way pipe 5 of the present embodiment may be formed of a three-way valve so as to control not only the refrigerant flow but also the refrigerant inflow rate to each of the second internal heat exchanger 3 and the bypass pipe 4 bypassing the second internal heat exchanger 3.

In the aforementioned dual-stage heat pump unit 1 of the present embodiment, when the low stage side compressor 11 of the low stage side refrigeration circuit 10 is operated, a refrigerant compressed by the low stage side compressor 11 so as to have a high temperature and high pressure exchanges, at the low stage side heating medium-refrigerant heat exchanger 12, heat with a heating medium flowing through the heating medium circuit 32 of the heating unit 30. Thereafter, the refrigerant flowed out of the low stage side heating medium-refrigerant heat exchanger 12 exchanges, at the cascade heat exchanger 13, heat with a refrigerant flowing through the high stage side refrigeration circuit 20, such that the refrigerant from the low stage side heating medium-refrigerant heat exchanger 12 is used as a heat absorbing source for the high stage side refrigeration circuit 20. Next, the refrigerant flowed out of the cascade heat exchanger 13 exchanges, at the first internal heat exchanger 18, heat with a low-temperature refrigerant flowing through the low-pressure side of the low stage side refrigeration circuit 10, and is subsequently decompressed by the low stage side expansion valve 14. The refrigerant decompressed by the low stage side expansion valve 14 flows into the evaporator 15, exchanges heat with an outside air, and thereby, pumps heat from the outside air. Thereafter, the refrigerant exchanges, at the first internal heat exchanger 18, heat with a high-temperature refrigerant flowing through the high-pressure side of the low stage side refrigeration circuit 10 so as to increase the temperature of the refrigerant, and then, flows into the second internal heat exchanger 3. The refrigerant exchanges, at the second internal heat exchanger 3, heat with a high-temperature refrigerant of the high stage side refrigeration circuit, if flowing on the high-pressure side of the high stage side refrigeration circuit, and then, returns to the low stage side compressor 11.

In the high stage side refrigeration circuit 20, when the high stage side compressor 21 is operated, the refrigerant, which has been compressed by the high stage side compressor 21 so as to have a high temperature and high pressure, exchanges, at the high stage side heating medium-refrigerant heat exchanger 22, heat with a heating medium flowing though the heating medium circuit 32 of the heating unit 30. Thereafter, when the electromagnetic open/close valve 6 is opened and the electromagnetic open/close valve 7 is closed, the refrigerant flowed out of the high stage side heating medium-refrigerant heat exchanger 22 flows into the second internal heat exchanger 3 to exchange heat with a low-temperature refrigerant on the low-pressure side of the low stage side refrigeration circuit, and then, reaches the high stage side expansion valve 23. On the other hand, when the electromagnetic open/close valve 6 is closed and the electromagnetic open/close valve 7 is opened, the refrigerant bypasses the second internal heat exchanger 3 to reach the high stage side expansion valve 23 via the bypass pipe 4.

The refrigerant having flowed into the high stage side expansion valve 23 is decompressed, and then, flows into the cascade heat exchanger 13. The refrigerant having flowed into the cascade heat exchanger 13 exchanges heat with a refrigerant flowing through the high-pressure side of the low stage side refrigeration circuit 10, and thereby, pumps heat from the low stage side refrigeration circuit 10 so as to increase the temperature of the refrigerant, and then, the refrigerant returns to the high stage side compressor 21.

Next, the heating unit 30 will be described. The heating unit 30 circulates and supplies hot water (water) as a heating medium to the heating terminal 31. Examples of the heating terminal 31 include a panel heater provided in each room of a house, etc. and a floor heating unit in which a heating medium flows through a pipe disposed under a floor. The heating terminal 31 is not limited to a single pipe type in which a heating medium flows through a plurality of panel heaters, pipes, or the like, in series, and may be a multiple pipe type in which a heating medium flows through a plurality of panel heaters, pipes, or the like, in parallel. In the present embodiment, hot water (water) is used as an example of the heating medium, but the heating medium is not limited thereto. For example, an anti-freeze liquid may be used.

The heating unit 30 includes the heating medium circuit 32 formed by annularly piping-connecting the aforementioned heating terminal 31, a flow rate adjusting valve 33 serving as flow rate adjusting means, a three-way valve 34 serving as branch flow adjusting means, the low stage side heating medium-refrigerant heat exchanger 12, the high stage side heating medium-refrigerant heat exchanger 22, a mixing tank 35, and a circulation pump 36.

As described above, the low stage side heating medium-refrigerant heat exchanger 12 performs heat exchange between a heating medium in the heating medium circuit 32 and a high-temperature refrigerant flowing through the high-pressure side of the low stage side refrigeration circuit 10. As described above, the high stage side heating medium-refrigerant heat exchanger 22 performs heat exchange between a heating medium in the heating medium circuit 32 and a high-temperature refrigerant flowing through the high-pressure side of the high stage side refrigeration circuit 20. In the heating medium circuit 32, the low stage side heating medium-refrigerant heat exchanger 12 and the high stage side heating medium-refrigerant heat exchanger 22 are disposed between the three-way valve 34 and the mixing tank 35 and are connected in parallel with each other. More specifically, the low stage side heating medium-refrigerant heat exchanger 12 is connected one of heating-medium flowout sides of the three-way valve 34 and the high stage side heating medium-refrigerant heat exchanger 22 is connected to the other heating-medium flowout side of the three-way valve 34. The heating medium flowout sides of both of the heating medium-refrigerant heat exchangers are connected to the mixing tank 35. The heating medium flowout sides of both of the heating medium-refrigerant heat exchangers are connected directly to the mixing tank 35 in the present embodiment, but the present invention is not limited to this configuration. The heating medium flowout sides may be joined to each other before being connected to the mixing tank 35.

In the heating unit 30, when the circulation pump 36 is operated, a heating medium discharged from the circulation pump 36 flows into the heating terminal 31, flows out of the heating terminal 31 to the heating medium circuit 32, reaches the three-way valve 34 via the flow rate adjusting valve 33, and is divided to the low stage side heating medium-refrigerant heat exchanger 12 and the high stage side heating medium-refrigerant heat exchanger 22 in accordance with the opening of the three-way valve 34. The heating medium having flowed in the low stage side heating medium-refrigerant heat exchanger 12 exchanges heat with a high-temperature refrigerant flowing through the low stage side refrigeration circuit 10. The heating medium having flowed in the high stage side heating medium-refrigerant heat exchanger 22 exchanges heat with a high-temperature refrigerant flowing through the high stage side refrigeration circuit 20. The heating mediums flowed out of the heat exchangers 12 and 22 are joined at the mixing tank 35, and return to the circulation pump 36. As a result of the operation of the circulation pump 36, the heating medium heated by the low stage side heating medium-refrigerant heat exchanger 12 and/or the high stage side heating medium-refrigerant heat exchanger 22 is used as a heat source for the heating terminal 31.

In the heating medium circuit 32 of the present embodiment, the low stage side heating medium-refrigerant heat exchanger 12 and the high stage side heating medium-refrigerant heat exchanger 22 are connected in parallel with each other via the three-way valve 34 serving as flow dividing means. However, in the present invention, the configuration of the heating medium circuit 32 is not limited to the above configuration. Even if the low stage side heating medium-refrigerant heat exchanger 12 and the high stage side heating medium-refrigerant heat exchanger 22 are connected in series, such a configuration does not have any influence on effects of the invention of the present application.

Figure 2:
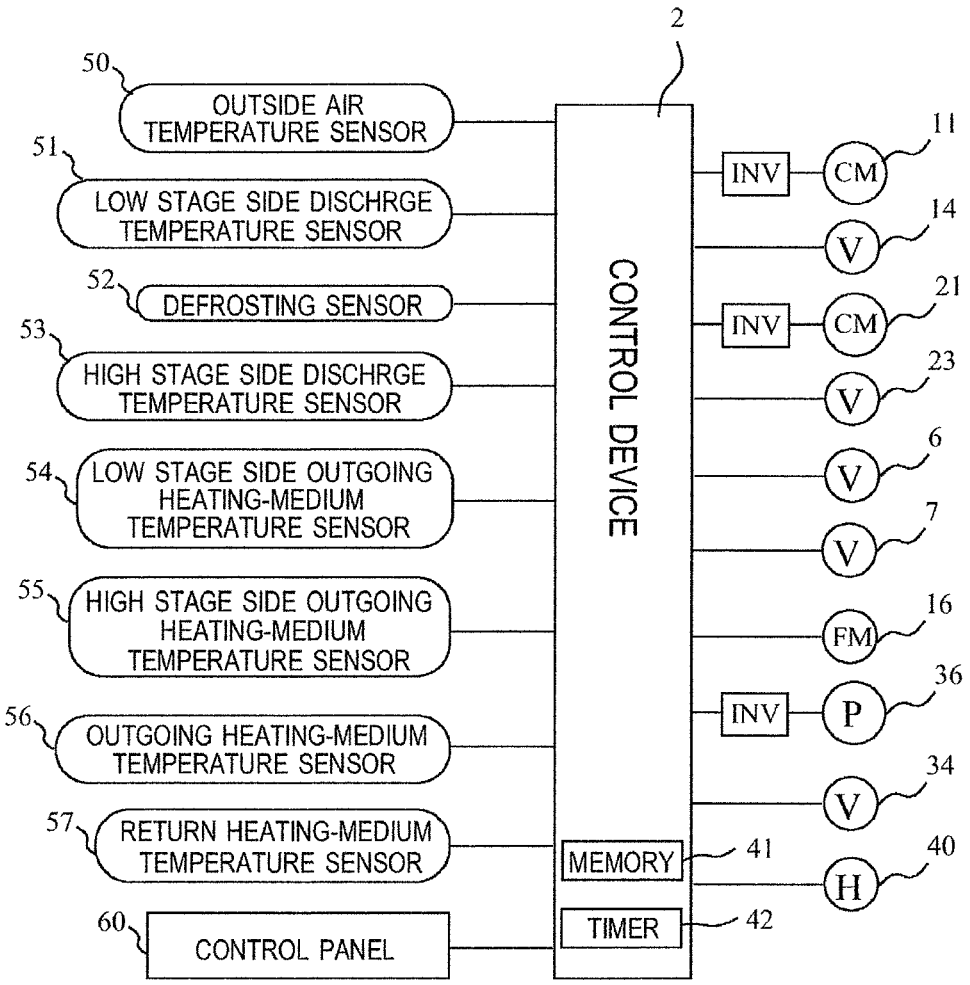
FIG. 2 is a control block diagram of the heat pump type heating apparatus according to the embodiment.

Next, a description of the control device 2 that controls the aforementioned dual-stage heat pump unit 1 and the heating unit 30 will be followed by a description of specific control of the heat pump type heating apparatus H according to the present invention. First, the control device 2 will be described with reference to a control block diagram of FIG. 2.

The control device 2 is formed of a general microcomputer, and also functions, together with the aforementioned electromagnetic open/close valves 6 and 7, as control means included in flow path control means of the preset invention. The control device 2 has a memory 41 serving as storage means, a timer 42 serving as time limiting means, and the like embedded therein.

The input side of the control device 2 is connected to an outside air temperature sensor 50 that detects the outside air temperature, a low stage side discharge temperature sensor 51 that detects a discharge temperature of the low stage side compressor 11, a defrosting temperature sensor 52 that detects the temperature of a refrigerant flowing into the evaporator 15 of the low stage side refrigeration circuit 10, a high stage side discharge temperature sensor 53 that detects a discharge temperature of the high stage side compressor 21, a low stage side outgoing heating-medium temperature sensor (low stage side outgoing heating-medium temperature detecting means) 54 that detects the temperature of a low stage side outgoing heating-medium being supplied from the low stage side heating medium-refrigerant heat exchanger 12 to the heating terminal 31, a high stage side outgoing heating-medium temperature sensor (high stage side outgoing heating-medium temperature detecting means) 55 that detects the temperature of a high stage side outgoing heating-medium being supplied from the high stage side heating medium-refrigerant heat exchanger 22 to the heating terminal 31, an outgoing heating-medium temperature sensor (outgoing temperature detecting means) 56 that detects the temperature of an outgoing heating medium which is the joined heating medium of a heating medium flowed out of the low stage side heating medium-refrigerant heat exchanger 12 and a heating medium flowed out of the high stage side heating medium-refrigerant heat exchanger 22 and which is being supplied to the heating terminal 31, a return heating-medium temperature sensor (return heating-medium temperature detecting means) 57 that detects the temperature of a return heating-medium flowed out of the heating terminal 31, a control panel 60 serving as input means configured to perform various setting, and the like.

In the heat pump type heating apparatus H of the present embodiment, the control panel 60 is configured to be able to arbitrarily set the temperature of an outgoing heating-medium being supplied to the heating terminal 31 within a prescribed temperature range. An allowable outgoing heating-medium temperature range is 40 to 70° C., for example. The allowable outgoing heating-medium temperature range is not limited to this, and may be arbitrarily determined in accordance with usage environment of the heat pump type heating apparatus H or the like.

The output side of the control device 2 is connected to the low stage side compressor 11, the low stage side expansion valve 14, the high stage side compressor 21, the high stage side expansion valve 23, the electromagnetic open/close valves 6 and 7, the evaporator blower 16, the circulation pump 36, the three-way valve 34, and the like.

In the present embodiment, connections relative to the low stage side compressor 11 and the high stage side compressor 21 are achieved via respective inverters. Thus, the control device 2 can control operation/stop of the compressors 11, 21 and can linearly control the operational frequencies of the compressors. A connection relative to the circulation pump 36 is also achieved via an inverter. The control device 2 can control operation/stop of the circulation pump 36 and can linearly control the rotation speed of the circulation pump 36 within a range from a prescribed lower limit to a prescribed upper limit.

Each of the low stage side expansion valve 14 and the high stage side expansion valve 23 is a so-called electronic expansion valve, and the valve opening thereof can be drivingly controlled by a stepping motor on the basis of a drive pulse generated by the control device 2. In addition, the valve opening of the three-way valve 34 can be linearly controlled by a stepping motor on the basis of a drive pulse generated by the control device 2 so as to control a flow dividing ratio of the refrigerant to the low stage side heating medium-refrigerant heat exchanger 12 and the high stage side heating medium-refrigerant heat exchanger 22.

Figure 3:
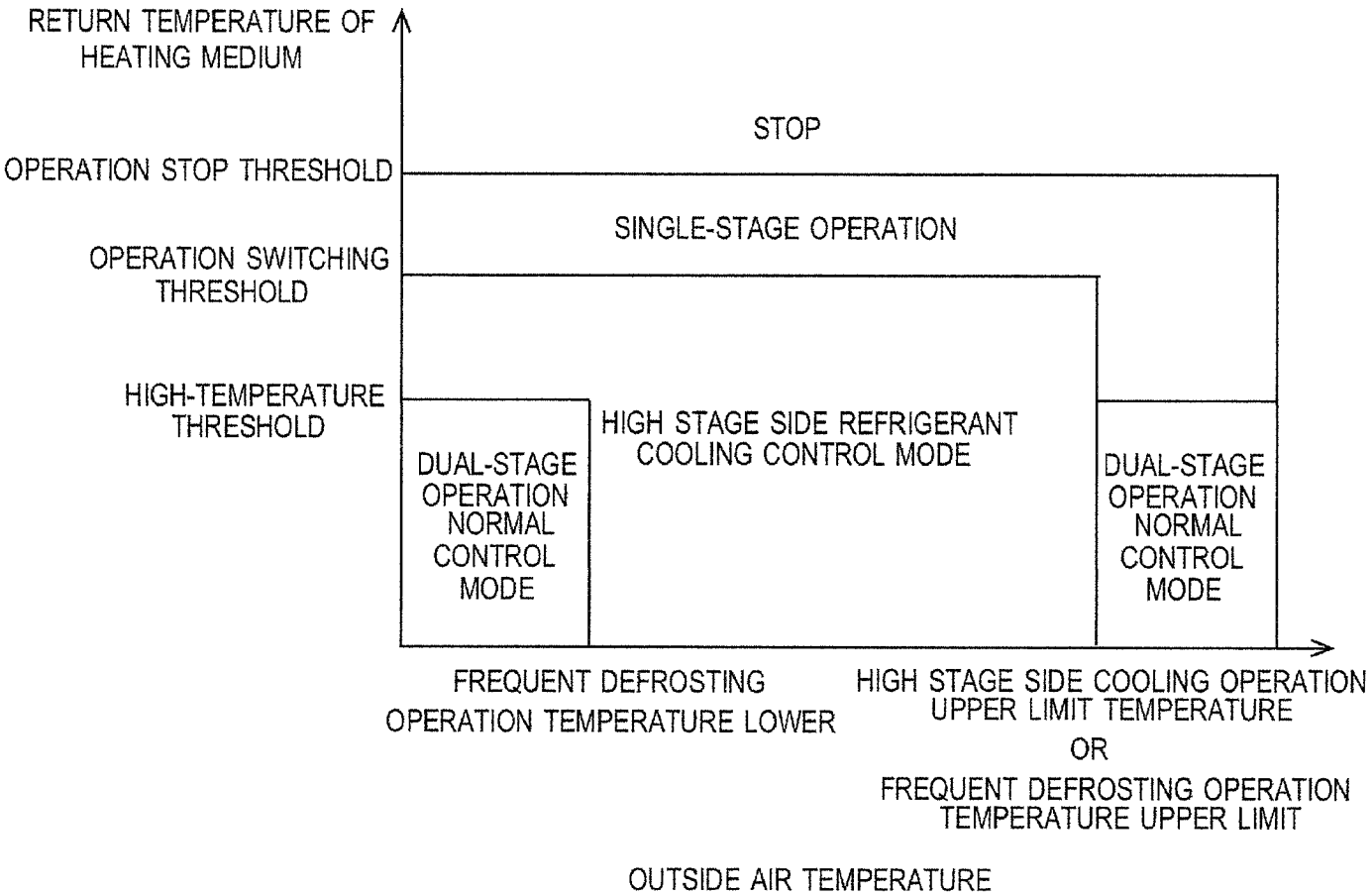
FIG. 3 is an operation region map of the heat pump type heating apparatus according to the embodiment.

With the above configuration, operation of the heat pump type heating apparatus H according to the present embodiment will be next described. The heat pump type heating apparatus H of the present embodiment controls, on the basis of an outside air temperature and a return temperature of a heating medium flowed out of the heating terminal 31, a shift among the single-stage operation in which only the low stage side compressor 11 is operated and the high stage side compressor 21 is stopped, the dual stage operation in which both the low stage side compressor 11 and the high stage side compressor 21 are operated, and the standby operation in which both the low stage side compressor 11 and the high stage side compressor 21 are stopped. Hereinafter, a specific operation will be described with reference to an operation region map in FIG. 3 and a flowchart in FIG. 4.

First, at step S1, the control device 2 determines whether or not the current return temperature of a heating medium flowed out of the heating terminal 31, or more specifically, a temperature detected by the return heating-medium temperature sensor 57 is lower than a prescribed high-temperature threshold stored in advance in the memory 41. This high-temperature threshold of the heating medium is preferably set to the limit of a heating-medium return temperature at which, when the dual-stage operation is performed without performing heat exchange between a refrigerant on the low-pressure side of the low stage side refrigeration circuit 10 and a refrigerant on the high-pressure side of the high stage side refrigeration circuit 20 in the second internal heat exchanger 3, the suction temperature or suction pressure of the low stage side compressor 11 and/or the high stage side compressor 21 falls within an appropriate range for use.

When determining, at step S1, that the current return temperature of the heating medium is lower than the high-temperature threshold, the control device 2 proceeds to step S11. At step S11, the control device 2 determines whether or not the current outside air temperature, or more specifically, a temperature detected by the outside air temperature sensor 50 falls within a prescribed frequent defrosting operation temperature range stored in advance in the memory 41. The upper limit temperature of the frequent defrosting operation temperature range is preferably set to the upper limit temperature of an outside air temperature at which the relative humidity is high and frost is likely to be formed in the evaporator 15 of the low stage side refrigeration circuit 10. More specifically, the upper limit temperature is more preferably set to an outside air temperature at which the relative humidity is 40% or higher. The lower limit temperature of the frequent defrosting operation temperature range is preferably set to a very low outside air temperature at which the heating performance is preferred, for example, to −5° C.

When determining, at step S11, that the current outside air temperature does not fall within the frequent defrosting operation temperature range, the control device 2 proceeds to step S2. At step S2, the control device 2 shifts the current operation state to a dual-stage operation normal control mode in which the dual stage operation of operating the low stage side compressor 11 and the high stage side compressor 21 is performed and heat exchange is not performed, at the second internal heat exchanger 3, between a low-temperature refrigerant on the low-pressure side of the low stage side refrigeration circuit 10 and a high-temperature refrigerant on the high-pressure side of the high pressure side refrigeration circuit 20. More specifically, the control device 2 closes the electromagnetic open/close valve 6 configured to control a refrigerant flow to the second internal heat exchanger 3, and opens the electromagnetic open/close valve 7 configured to control a refrigerant flow to the bypass pipe 4 bypassing the second internal heat exchanger 3, in the high-pressure side refrigeration circuit 20.

In the dual-stage operation normal control mode, the high-temperature refrigerant on the high-pressure side of the high stage side refrigeration circuit 20 is caused to flow into the bypass pipe 4 side bypassing the second internal heat exchanger 3, so that heat exchange is not performed between the low-temperature refrigerant on the low-pressure side of the low stage side refrigeration circuit 10 and the high-temperature refrigerant on the high-pressure side of the high stage side refrigeration circuit 20. Accordingly, heating performance is sufficiently exhibited and more efficient heating operation can be performed. After that, the control device 2 returns to step S1 from step S2.

When determining, at step S11, that the current outside air temperature falls within the frequent defrosting operation temperature range, the control device 2 proceeds to step S12. At step S12, the control device 2 shifts the current operation state to a high stage side refrigerant cooling control mode in which heat exchange is performed between the low-temperature refrigerant on the low-pressure side of the low stage side refrigeration circuit 10 and the high-temperature refrigerant on the high-pressure side of the high-pressure side refrigeration circuit 20 in the second internal heat exchanger 3. More specifically, the control device 2 opens the electromagnetic open/close valve 6 configured to control a refrigerant flow to the second internal heat exchanger 3, and closes the electromagnetic open/close valve 7 configured to control a refrigerant flow to the bypass pipe 4 bypassing the second internal heat exchanger 3, in the high-pressure side refrigeration circuit 20.

In this way, when the return temperature of a heating medium flowed out of the heating terminal 31 is higher than the prescribed high-temperature threshold and the outside air temperature falls within the frequent defrosting operation temperature range during the dual-stage operation in which both the low stage side compressor 11 and the high stage side compressor 21 are operated, the heat pump type heating apparatus H according to the present embodiment causes the high-temperature refrigerant on the high-pressure side of the high stage side refrigeration circuit 20 to flow into the second internal heat exchanger 3 so that the refrigerant can exchange, at the second internal heat exchanger 3, heat with the low-temperature refrigerant on the low-pressure side of the low stage side refrigeration circuit 10.

Accordingly, when the outside air temperature falls within the frequent defrosting operation temperature range during the dual-stage operation, the temperature of the low-temperature refrigerant on the low-pressure side of the low stage side refrigeration circuit 10 is increased so that the temperature of the entire low stage side refrigeration circuit 10 can be increased. That is, the suction temperature of a refrigerant to the low-pressure side compressor 11 can be increased and the temperature of the refrigerant flowing into the evaporator 15 can be increased. In a normal defrosting operation on the evaporator 15, the defrosting temperature sensor 52 detects the temperature of a refrigerant flowing into the evaporator 15, and when the temperature is lower than a prescribed threshold, the low stage side expansion valve 14 is fully opened to cause a high-temperature refrigerant to flow into the evaporator 15. Thus, when the outside air temperature is in a temperature range at which the relative humidity becomes high, frost is likely to be formed in the evaporator 15, and thus, a defrosting operation is frequently performed. In contrast, according to the present invention, when the outside air temperature falls within the frequent defrosting operation temperature range at which the relative humidity becomes high, the mode is shifted to the high stage side refrigerant cooling control mode, the temperature of a refrigerant flowing into the evaporator 15 is increased, and thereby, frost formation in the evaporator 15 is suppressed. Thus, frequently performing a defrosting operation can be avoided. Therefore, the sense of being insufficiently warmed due to a defrosting operation can be greatly improved.

On the other hand, when determining, at step S1, that the current return temperature of the heating medium is equal to or higher than the high-temperature threshold, the control device 2 proceeds to step S3 to determine whether or not the current return temperature of the heating medium is higher than the high-temperature threshold but is lower than a prescribed operation switching threshold stored in advance in the memory 41. The operation switching threshold of the return temperature of the heating medium is preferably set to the limit of a heating-medium return temperature at which, when the dual-stage operation is performed while heat exchange is performed, at the second internal heat exchanger 3, between the refrigerant on the low-pressure side of the low stage side refrigeration circuit 10 and the refrigerant on the high pressure side of the high stage side refrigeration circuit 20, the suction temperature or suction pressure of the low stage side compressor 11 and/or the high stage side compressor 21 falls within an appropriate range for use.

When determining, at step S3, that the current return temperature of the heating medium is lower than the operation switching threshold, the control device 2 proceeds to step S4 to determine whether or not the current outside air temperature, or more specifically, a temperature detected by the outside air temperature sensor 50 is equal to or lower than a prescribed high stage side cooling operation upper limit temperature stored in advance in the memory 41. The high stage side cooling operation upper limit temperature is preferably set to a higher one of limit temperatures at which, when the high stage side refrigerant cooling control mode of performing, at the second internal heat exchanger 3, heat exchange between the low-temperature refrigerant on the low-pressure side of the low stage side refrigeration circuit 10 and the high-temperature refrigerant on the high-pressure side of the high stage side refrigeration circuit 20 is executed during the dual-stage operation, the suction temperature or suction pressure of the low stage side compressor and/or the high stage side compressor falls within an appropriate range for use.

When determining, at step S4, that the current outside air temperature is higher than the aforementioned high stage side cooling operation upper limit temperature, the control device 2 proceeds to step S5 to shift to the single-stage operation in which operation of the high stage side compressor 21 is stopped and only the low stage side compressor 11 is operated. Subsequently, the control device 2 returns to step S1.

On the other hand, when determining, at step S4, that the current outside air temperature is equal to or lower than the aforementioned high stage side cooling operation upper limit temperature, the control device 2 proceeds to step S6. At step S6, the control device 2 shifts the current operation state to the high stage side refrigerant cooling control mode in which heat exchange is performed, at the second internal heat exchanger 3, between the low-temperature refrigerant on the low-pressure side of the low stage side refrigeration circuit 10 and the high-temperature refrigerant on the high-pressure side of the high-pressure side refrigeration circuit 20. More specifically, the control device 2 opens the electromagnetic open/close valve 6 configured to control a refrigerant flow to the second internal heat exchanger 3 and closes the electromagnetic open/close valve 7 configured to control a refrigerant flow to the bypass pipe 4 bypassing the second internal heat exchanger 3, in the high-pressure side refrigeration circuit 20.

In this way, when the return temperature of the heating medium flowed out of the heating terminal 31 is higher than the prescribed high-temperature threshold and the outside air temperature is equal to or lower than the high stage side cooling operation upper limit temperature in the dual-stage operation of operating both the low stage side compressor 11 and the high stage side compressor 21, the heat pump type heating apparatus H according to the present embodiment causes the high-temperature refrigerant on the high-pressure side of the high stage side refrigeration circuit 20 to flow into the second internal heat exchanger 3 such that the refrigerant can exchange, at the second internal heat exchanger 3, heat with the low-temperature refrigerant on the low-pressure side of the low stage side refrigeration circuit 10.

Figure 5:
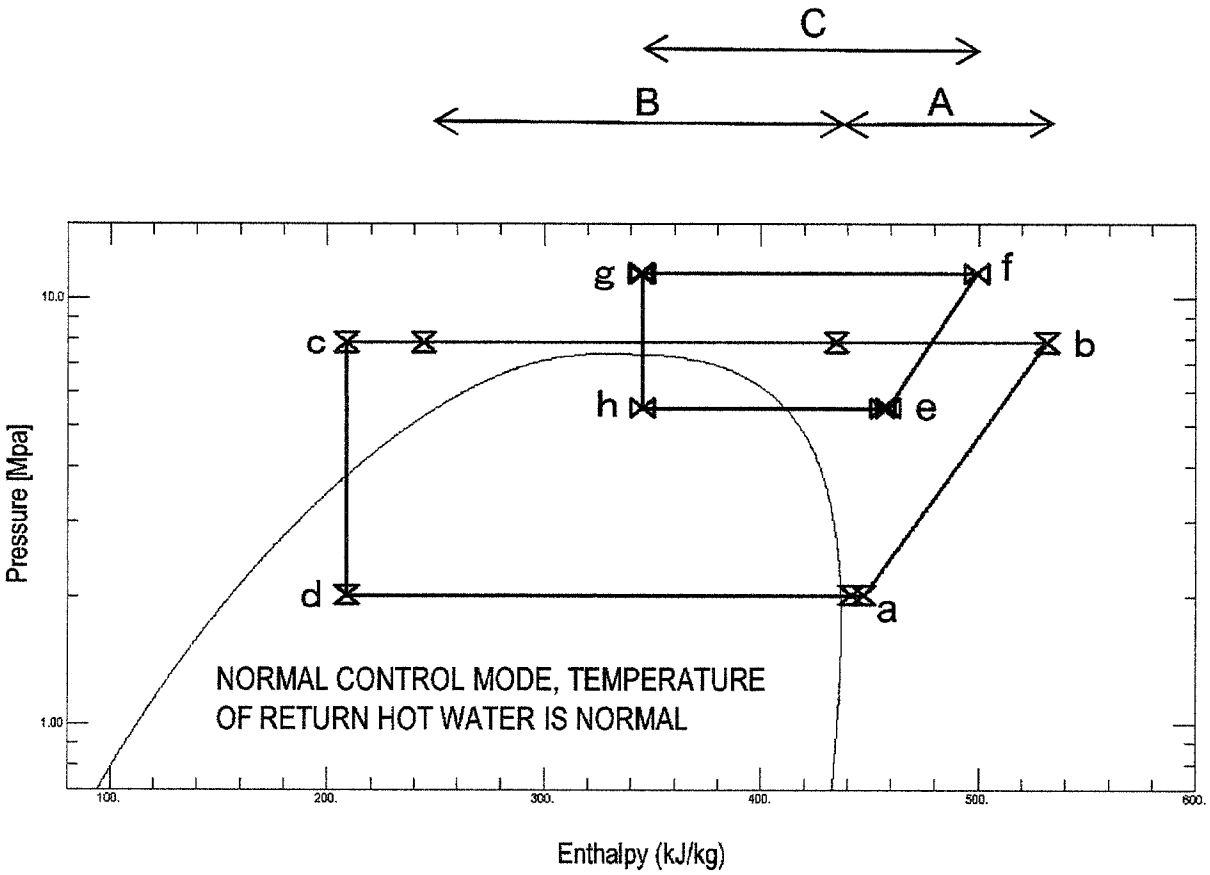
FIG. 5 is a Mollier chart in a case where a return temperature of a heating medium in a dual-stage operation normal control mode is a high temperature threshold.
Figure 6:
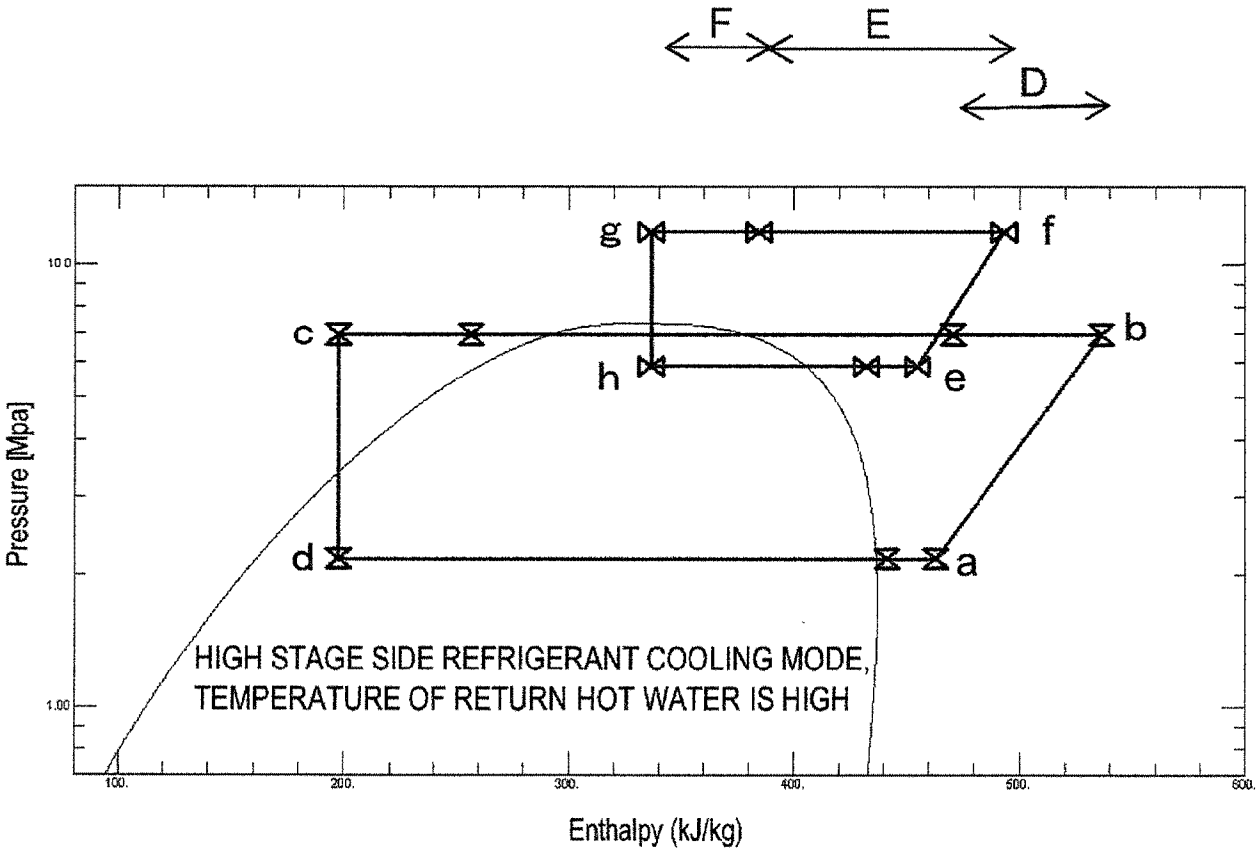
FIG. 6 is a Mollier chart in a case where a return temperature of a heating medium in a high stage side refrigerant cooling control mode is an operation switching threshold.
Figure 7:
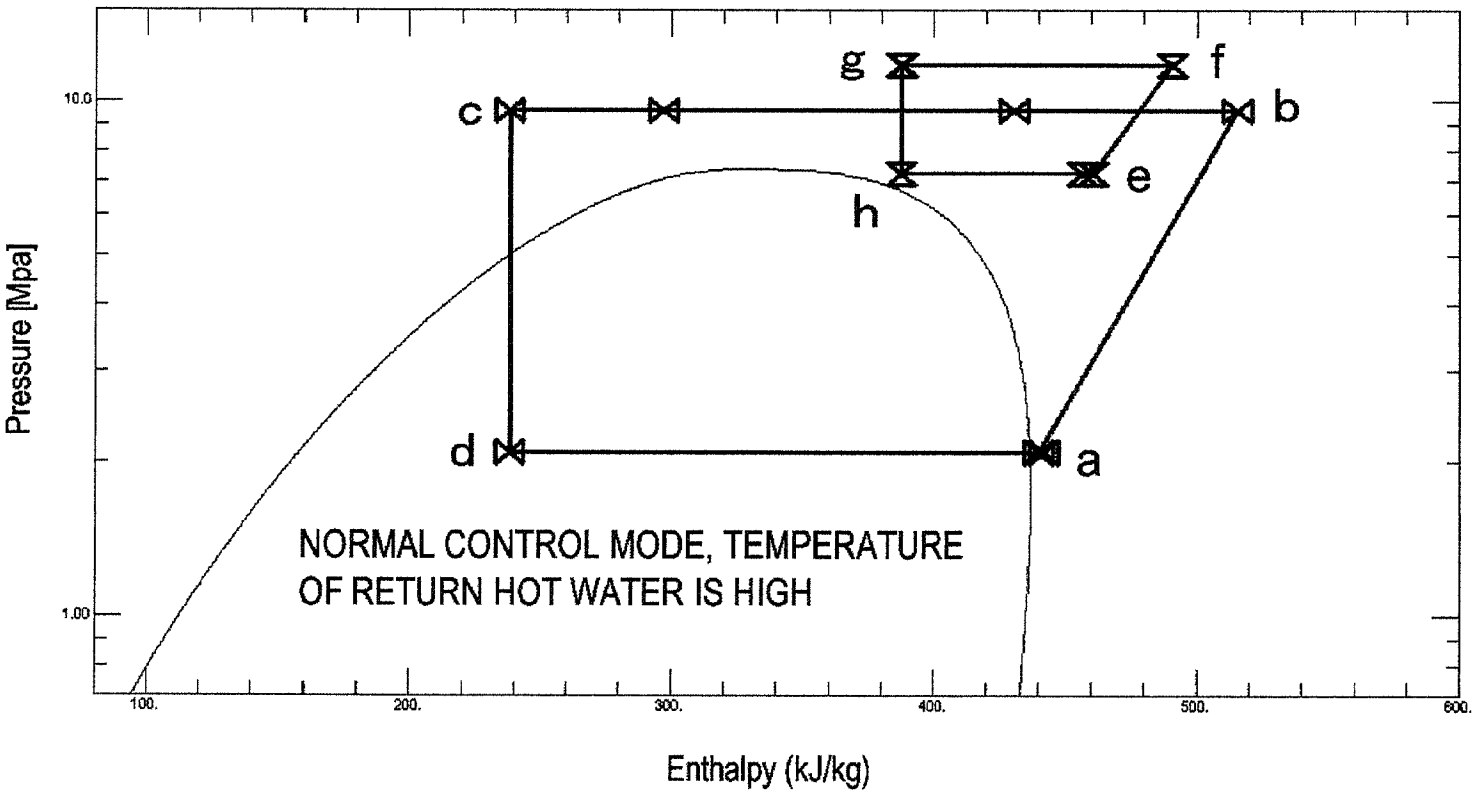
FIG. 7 is a Mollier chart in a case where a return temperature of a heating medium is the operation switching threshold while the dual-stage operation normal control mode is continued.

FIGS. 5 to 7 each show a Mollier chart of the low stage side refrigeration circuit 10 and the high stage side refrigeration circuit 20 of the present embodiment. FIG. 5 is a Mollier chart in a case where the return temperature of the heating medium in the dual-stage operation normal control mode is set to the prescribed high-temperature threshold. FIG. 6 is a Mollier chart in a case where the return temperature of the heating medium in the high stage side refrigerant cooling control mode is set to the prescribed operation switching threshold. FIG. 7 is provided for comparison with the present embodiment, and is a Mollier chart in a case where the return temperature of the heating medium is set to the prescribed operation switching threshold while the dual-stage operation normal control mode is kept.

In the charts, "a→b→c→d" indicates a heat cycle in the low stage side refrigeration circuit 10 and "e→f→g→h" indicates a heat cycle in the high stage side refrigeration circuit 20. In FIG. 5, "A" represents a quantity of heat obtained by the low stage side heating medium-refrigerant heat exchanger 12, and "B" represents a quantity of heat obtained by the high stage side heating medium-refrigerant heat exchanger 22. The added value of A and B is a quantity of heat for heating. In FIG. 5, "C" represents a quantity of excess heat which is higher than the outside air temperature but is difficult to use for heating. At the cascade heat exchanger 13, the quantity of excess heat of the low stage side refrigeration circuit 10 is used as a heat absorbing source for the high stage side refrigeration circuit 20. In this way, in the heat pump type heating apparatus H, the excess heat of the low stage side refrigeration circuit 10 which cannot be used directly for heating but is higher than the outside air temperature is favorably recovered, at the cascade heat exchanger 13, as a heat absorbing source for the high stage side refrigeration circuit 20, and thus, the compression ratio can be reduced compared to a case where the outside air is used as the heat absorbing source, and thereby, operation with a high COP can be performed.

In FIG. 6, "D" represents a quantity of heat obtained by the low stage side heating medium-refrigerant heat exchanger 12, and "E" represents a quantity of heat obtained by the high stage side heating medium-refrigerant heat exchanger 22. "F" represents excess heat of the high stage side refrigeration circuit 20 in the second internal heat exchanger 3, and is recovered as a heat absorbing source for the low stage side refrigeration circuit 10. In FIG. 7, since heat exchange is not performed, at the second internal heat exchanger 3, between the high-temperature refrigerant on the high-pressure side of the high stage side refrigeration circuit 20 and the low-temperature refrigerant on the low-pressure side of the low stage side refrigeration circuit 10, recovery of excess heat of the high stage side refrigeration circuit 20 to the low stage side refrigeration circuit 10 as in FIG. 6 is not performed. Thus, in FIG. 7, the return temperature of the heating medium is high, and the heat of the refrigerant in the high stage side refrigeration circuit 20 is not sufficiently dissipated at the high stage side heating medium-refrigerant heat exchanger 22 of the high stage side refrigeration circuit 20, and thus, the pressure in the circuit cannot be sufficiently reduced even by being decompressed by the high stage side expansion valve 23. For this reason, FIG. 7 shows that the refrigerant is sucked into the high stage side compressor 21 while maintaining a high pressure. In contrast, in FIG. 6, excess heat of the high stage side refrigeration circuit 20 is recovered, at the second internal heat exchanger 3, by the low stage side refrigeration circuit 10, and thus, decompression can be performed by the high stage side expansion valve 23 in a state where the enthalpy is sufficiently reduced. Accordingly, it is understood that the refrigerant can be sucked into the high stage side compressor 21 in a state where the pressure in the circuit is sufficiently reduced.

As is clear from the above description using the Mollier charts, in the heat pump type heating apparatus H according to the present invention, heat exchange is performed, at the second internal heat exchanger 3, between the high-temperature refrigerant on the high-pressure side of the high stage side refrigeration circuit 20 and the low-temperature refrigerant on the low-pressure side of the low stage side refrigeration circuit 10, so that the temperature of the refrigerant on the high-pressure side of the high stage side refrigeration circuit 20 can be efficiently reduced and the temperature or pressure of the refrigerant to be sucked into the high stage side compressor 21 can be reduced. For this reason, even when the heating-medium return temperature reaches such a temperature as to make a continuous operation of a compressor impossible in a conventional apparatus, the suction temperature or suction pressure of the high stage side compressor 21 can fall within an appropriate range for use, and the dual-stage operation can be continued.

Therefore, since a shift from the dual-stage operation to the single-stage operation of operating the low stage side compressor 11 only can be suppressed to the utmost, it is possible to avoid in advance temperature decrease in a space being heated and generation of the sense of being insufficiently warmed, which are caused by suspension of the high stage side compressor 21.

Furthermore, in the present embodiment, when, in the dual-stage operation, the return temperature of the heating medium flowed out of the heating terminal 31 is determined to be equal to or higher than the prescribed high-temperature at step S1, the control device 2 controls opening/closing of the electromagnetic open/close valves 6 and 7 at step S6, such that the high-temperature refrigerant on the high-pressure side of the high stage side refrigeration circuit 20 having excess heat flows into the second internal heat exchanger 3 to exchange, at the second internal heat exchanger 3, heat with the low-temperature refrigerant on the low-pressure side of the low stage side refrigeration circuit 10. Accordingly, even when the return temperature of the heating medium is equal to or higher than the high-temperature threshold, the heating performance exerted by the high stage side refrigeration circuit 20 can be reduced to suppress increase of the suction temperature or suction pressure of the high stage side compressor 21. Thus, as described above, even when the return temperature of the heating medium is equal to or higher than the high-temperature threshold, the dual-stage operation can be continued.

Moreover, in the present embodiment, when determining, at step S4, that the outside air temperature is determined to be equal to or lower than the prescribed high stage side cooling operation upper limit temperature, the control device 2 causes the refrigerant on the high-pressure side of the high stage side refrigeration circuit 20 to flow into the second internal heat exchanger 3, and thereby, suppressing abnormal increase of the suction temperature and suction pressure of the low stage side compressor 11. Thus, the dual-stage operation can be continued.

Figure 4:
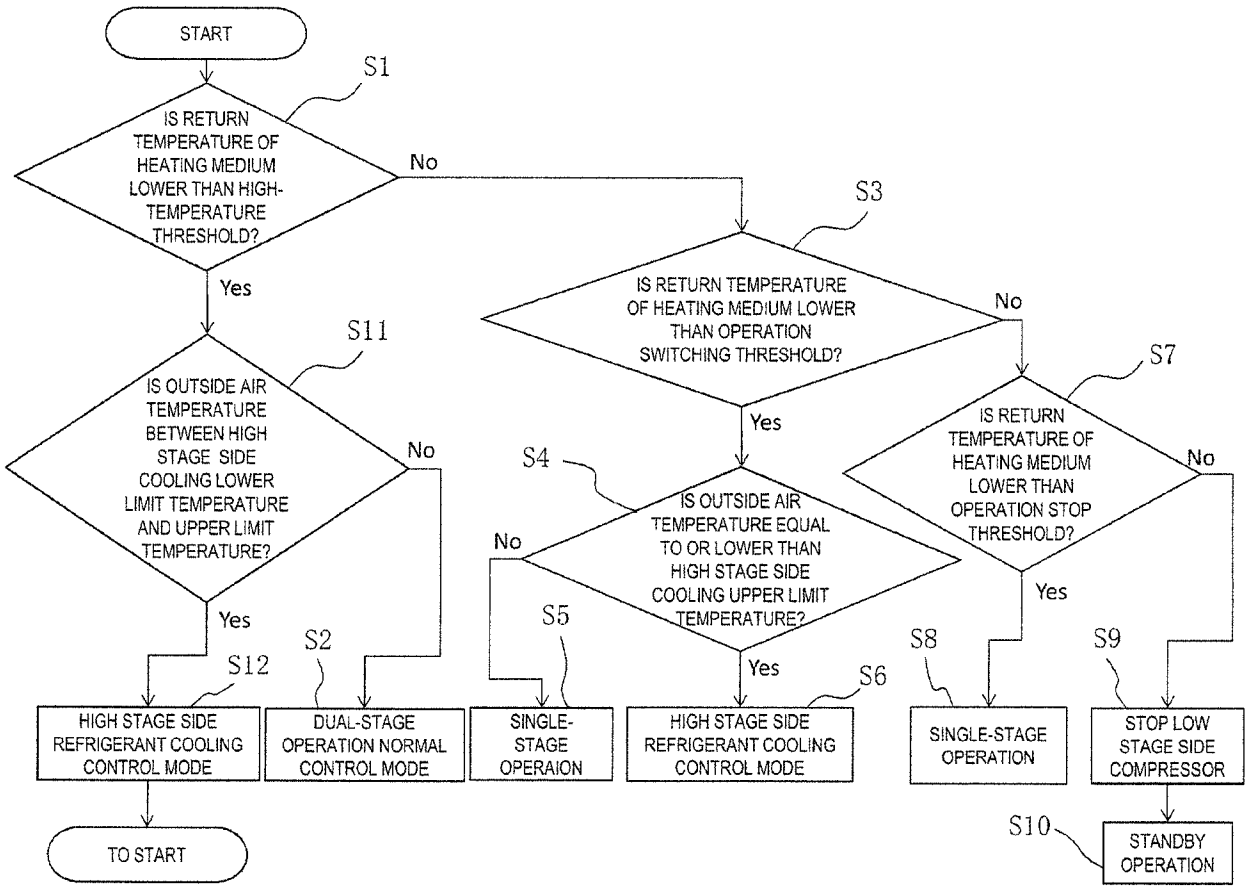
FIG. 4 is a control flowchart of FIG. 3.

As described above, after a shift to the high stage side refrigerant cooling control mode at step S6 in the flowchart of FIG. 4, the control device 2 returns to step S1. On the other hand, when determining, at step S3, that the current return temperature of the heating medium is equal to or higher than the aforementioned operation switching threshold, the control device 2 proceeds to step S7. At step S7, the control device 2 determines whether or not the current return temperature of heating medium is lower than a prescribed operation stop threshold stored in advance in the memory 41. The operation stop threshold of the return temperature of the heating medium is preferably set to the limit of a heating-medium return temperature at which, in the single-operation, the suction temperature or suction pressure of the low stage side compressor 11 falls within an appropriate range for use. When determining, at step S7, that the current return temperature of the heating medium is lower than the operation stop threshold, the control device 2 proceeds to step S8 to shift to the single-stage operation in which the operation of the high stage side compressor 21 is stopped and only the low stage side compressor 11 is operated. After that, the control device 2 returns to step S1.

In the present embodiment, when, after returning to step S1 from step S8, the return temperature of the heating medium is lower than the prescribed high-temperature threshold, the control device 2 is restored to the dual-stage operation from the single-stage operation. Also, when the return temperature of the heating medium is equal to or higher than the prescribed high-temperature threshold (No at step S1) but is lower than the prescribed operation switching threshold (Yes at step S3), the control device 2 is restored to the dual-stage operation from the single-stage operation. Here, a prescribed temperature range is set for the operation switching threshold. For example, when the dual-stage operation is restored from the single-stage operation, it is preferable that a lower temperature is used as the operation switching threshold for restoration from the single-stage operation to the dual-stage operation, compared to the temperature for restoration from the dual-stage operation to the single-stage operation. In addition, in order to avoid frequent start/stop of the high stage side compressor 21, it is preferable that operation of the high stage side compressor 21 is restarted on condition that a prescribed time has been elapsed since stop of the compressor to be started.

When determining, at step S7, that the current return temperature of the heating medium is equal to or higher than the operation stop threshold, the control device 2 proceeds to step S9 to stop the operation of the low stage side compressor 11 and then proceeds to step S10 to shift to the standby operation. In the standby operation, the control device 2 determines whether or not the current return temperature of the heating medium is lower than a prescribed low-temperature threshold for restarting the operation stored in advance in the memory 41. When the current return temperature of the heating medium is lower than the low-temperature threshold, the control device 2 shifts to the single-stage operation or the dual-stage operation by operating only the low stage side compressor 11, or by operating the low stage side compressor 11 and the high stage side compressor 21. In order to avoid frequent start/stop of the compressors, it is preferable that operation of the compressor to be started is restarted on condition that a prescribed time has been elapsed since stop of the compressor.

In the present embodiment, when the return temperature of the heating medium is equal to or higher than the operation switching threshold but is lower than the operation stop threshold, the single-stage operation is performed. For this reason, the dual-stage operation is shifted to the single-stage operation at step S8. However, the present invention is not limited to this configuration. When the operation switching threshold is increased and set to the operation stop threshold, not only the operation of the high stage side compressor 21 but also the operation of the low stage side compressor 11 may be stopped at step S8, and then, the operation may be shifted to the standby operation.

Moreover, in the present embodiment, the bypass pipe 4 bypassing the second internal heat exchanger 3 is provided between the refrigerant flowout side of the high stage side heating medium-refrigerant heat exchanger 22 and the refrigerant inflow side of the high stage side expansion valve 23 in the high stage side refrigeration circuit 20, as described above, so as to control switching between a refrigerant flow to the second internal heat exchanger 3 side and a refrigerant flow to the bypass pipe 4 side, so that switching is controlled between the high stage side refrigerant cooling control mode in which heat exchange is performed between the low-temperature refrigerant on the low-pressure side of the low stage side refrigeration circuit 10 and the high-temperature refrigerant on the high-pressure side of the high stage side refrigeration circuit 20, and the dual-stage operation normal control mode in which the heat exchange is not performed.

However, the present invention is not limited to the above configuration. The bypass pipe 4 bypassing the second internal heat exchanger 3 may be provided between the refrigerant flowout side of the evaporator 15 and the refrigerant suction side of the low stage side compressor 11 in the low stage side refrigeration circuit 10 so as to control a refrigerant flow to the second internal heat exchanger 3 side or the bypass pipe 4 side, so that switching is controlled between the high stage side refrigerant cooling control mode in which heat exchange is performed between the low-temperature refrigerant on the low-pressure side of the low stage side refrigeration circuit 10 and the high-temperature refrigerant on the high-pressure side of the high stage side refrigeration circuit 20, and the dual-stage operation normal control mode in which the heat exchange is not performed.

[Example]

Next, a description will be given of an example using the heat pump type heating apparatus according to the present invention. In the present example, the aforementioned heat pump type heating apparatus H according to the present embodiment was used. The present example used an operation condition that an outgoing temperature of a heating medium was 70° C., the outside air temperature was −10° C., the operational frequency of the low-pressure side compressor 11 was 80 Hz, and the operational frequency of the high-pressure side compressor 21 was 51 Hz, the circulation flow rate of a heating medium was 5.6 L/min in the dual-stage operation normal control mode and 4.4 L/min in the high stage side refrigerant cooling control mode (when the return temperature of the heating medium was 58° C.) Hereinafter, a description will be given of a case where the return temperature of the heating medium was varied while the dual-stage operation normal control mode was maintained and a case where the return temperature of the heating medium was varied while the high stage side refrigerant cooling control mode was maintained, with reference to the drawings.

Figure 8:
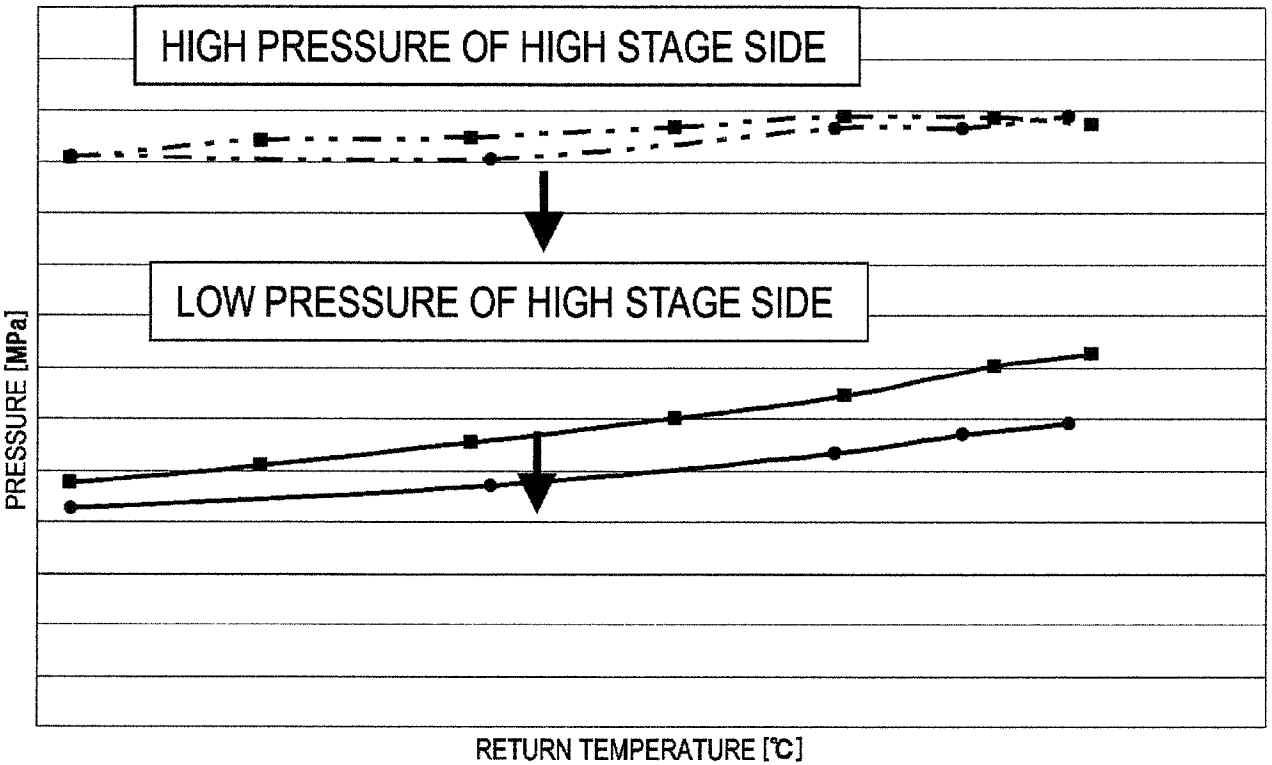
FIG. 8 shows pressure transition in a high stage side refrigeration circuit when a return temperature of a heating medium is varied.

FIG. 8 is a diagram showing pressure transition in the high stage side refrigeration circuit 20 in a case where the return temperature of the heating medium was varied under the above operation condition. In FIG. 8, a solid line indicates pressure transition on the low-pressure side of the high stage side refrigeration circuit 20, and a dotted line indicates pressure transition on the high-pressure side of the high stage side refrigeration circuit 20. Black squares are added to the transition obtained by maintaining the dual-stage operation normal control mode, and black circles are added to the transition obtained by maintaining the high stage side refrigerant cooling control mode.

FIG. 8 shows that the pressures on both the high-pressure side and the low-pressure side in the high stage side refrigerant cooling control mode were lower than those in the dual-stage operation normal control mode. For example, the pressure on the high-pressure side was lower by 0.4 MPa at a heating-medium return temperature of 48° C. which was higher than the aforementioned high-temperature threshold. It was confirmed that even when the return temperature of the heating-medium was increased, the pressure on the high stage side did not greatly decrease due to execution of the high stage side refrigerant cooling control mode and fallen within a range for using the high stage side compressor.

On the other hand, the pressure on the low-pressure side had a tendency of increasing with the increase of the return temperature of the heating medium, during both the dual-stage operation normal control mode and the high stage side refrigerant cooling control mode. It is understood that, at any of the heating-medium return temperatures, the pressure was greatly reduced in the high stage side refrigerant cooling control mode in which heat exchange was performed between the low stage side refrigeration circuit and the high stage side refrigeration circuit, compared to that in the dual-stage operation normal control mode. For example, when the return temperature of the heating medium was 48° C. which was higher than the aforementioned high-temperature threshold, the pressure was decreased by 0.8 MPa. It is understood that under condition that the heating-medium return temperature was higher, the pressure on the low stage side, that is, the suction pressure of the high stage side compressor 21 can be reduced more efficiently by execution of the high stage side refrigerant cooling control mode.

Figure 9:
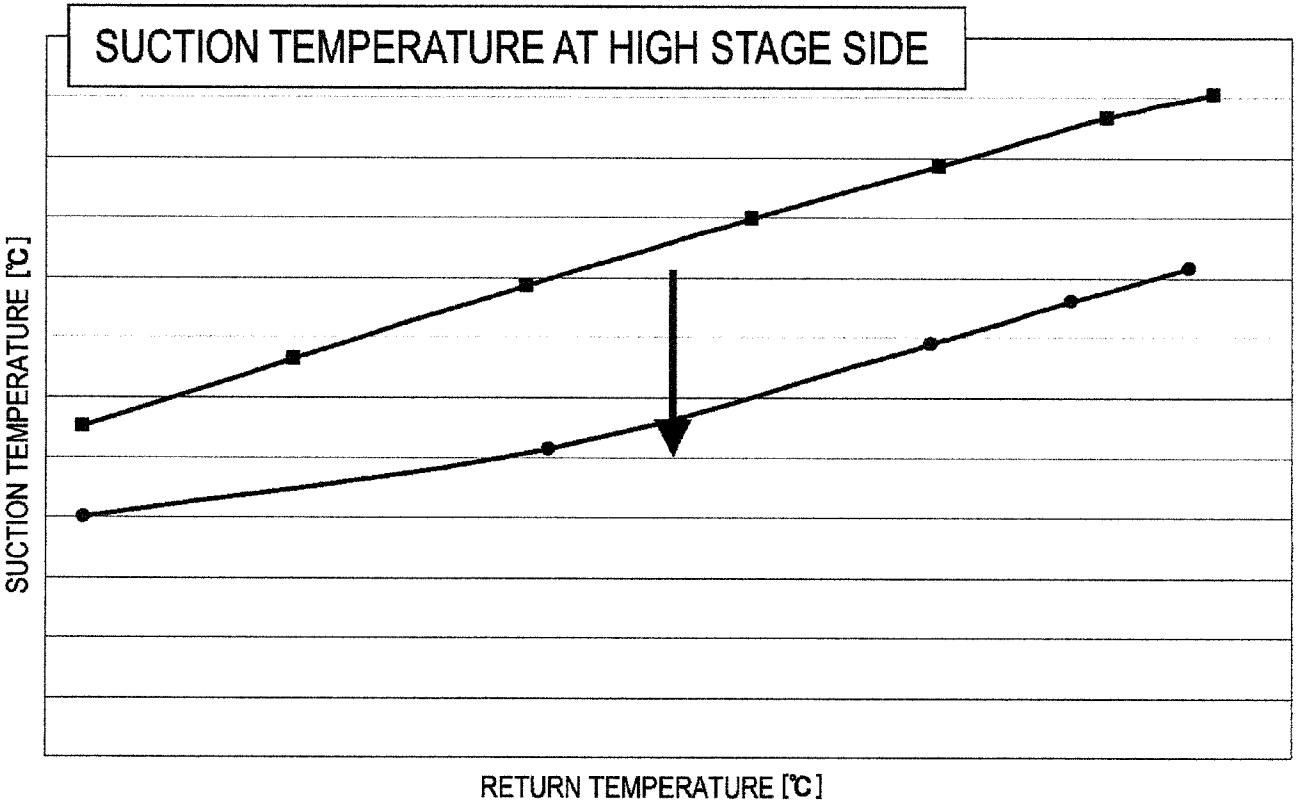
FIG. 9 shows transition of the suction temperature of a high stage side compressor when a return temperature of a heating medium is varied.

FIG. 9 shows transition of the suction temperature of the high stage side compressor 21 in a case where the heating-medium return temperature was varied under the aforementioned operation condition. In FIG. 9, black squares are added to the transition obtained by maintaining the dual-stage operation normal control mode, and black circles are added to the transition obtained by maintaining the high stage side refrigerant cooling control mode.

FIG. 9 shows that when the high stage side refrigerant cooling control mode was executed, the suction temperature of the high stage side compressor 21 had a tendency of increasing with the increase of the heating-medium return temperature, compared to that in the dual-stage operation normal control mode. At any return temperature of the heating medium, the suction temperature of the high stage side compressor 21 was greatly decreased in the high stage side refrigerant cooling control mode in which heat exchange was performed between the low stage side refrigeration circuit and the high stage side refrigeration circuit, compared to that in the dual-stage operation normal control mode. For example, when the return temperature of the heating medium was 48° C. which was higher than the aforementioned high-temperature threshold, the suction temperature was decreased by 14° C.

Accordingly, from both the experiment results in FIGS. 8 and 9, it is understood that even when the return temperature of the heating medium reaches such a temperature as to make a continuous operation of the high stage side compressor impossible in a conventional apparatus, which does not adopt the high stage side refrigerant cooling control mode, the suction temperature or suction pressure of the high stage side compressor can fall within the appropriate range for use, by execution of the high stage side refrigerant cooling control mode, so that the dual-stage operation can be continued until a higher return heating-medium temperature is reached.

Figure 10:
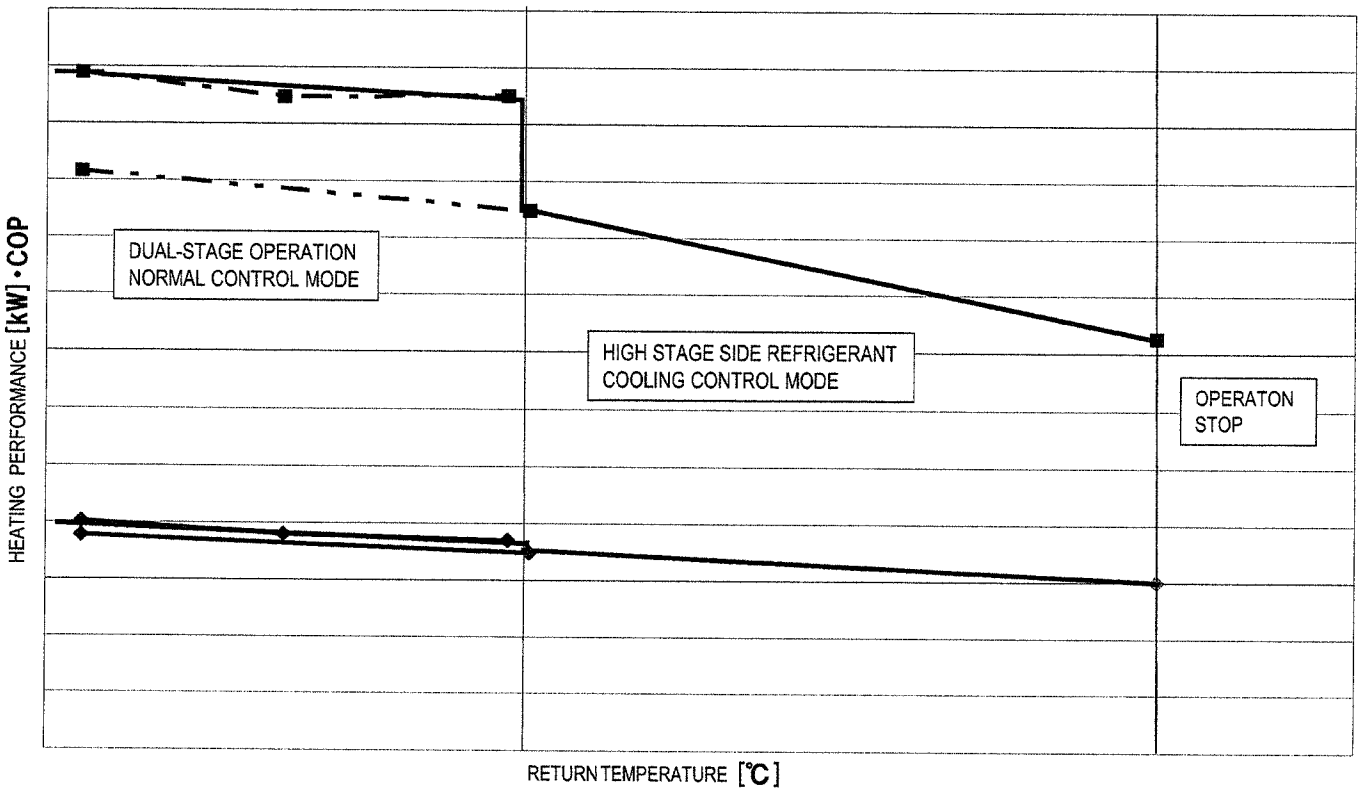
FIG. 10 shows heating performance transition and COP transition of the entire heat pump type heating apparatus when a dual-stage operation normal control mode is switched to a high stage side refrigerant cooling control mode at a high temperature threshold.

FIG. 10 shows heating performance transition and COP transition of the entire heat pump type heating apparatus H in a case where the dual-stage operation normal control mode was shifted to the high stage side refrigerant cooling control mode when the return temperature of the heating-medium was the aforementioned high-temperature threshold (47° C.). When the heating-medium return temperature is lower than 47° C. corresponding to the high-temperature threshold, the dual-stage operation normal control mode is executed, and thus, heat exchange is not performed, at the second internal heat exchanger 3, between the high-pressure side of the high stage side refrigeration circuit 20 and the low-pressure side of the low stage side refrigeration circuit. Therefore, the dual-stage operation can be performed with high heating performance until the return temperature of the heating medium reaches the high-temperature threshold.

When the heating-medium return temperature is equal to or higher than the high-temperature threshold, continuation of the dual-stage operation normal control mode may cause the suction pressure or suction temperature of the low stage side compressor to deviate from the appropriate range for use. However, when the return temperature of the heating medium is equal to or higher than the high-temperature threshold, the operation is shifted to the high stage side refrigerant cooling control mode in which heat exchange is performed, at the second internal heat exchanger 3, between the high-pressure side of the high stage side refrigeration circuit 20 and the low-pressure side of the low stage side refrigeration circuit. Accordingly, the dual-stage operation can be continued without causing the suction pressure or suction temperature of the low stage side compressor to deviate from the appropriate range for use.

As is clear from FIG. 10, in this case, when the return temperature of the heating medium was around 47° C., the heating performance was 5.8 kW in the dual-stage operation normal control mode, while the heating performance was decreased to 4.8 kW in the high stage side refrigerant cooling control mode. In the high stage side refrigerant cooling control mode, the heat exchange efficiency of the high stage side heating medium-refrigerant heat exchanger 22 is decreased with the increase of the return temperature of the heating medium, so that the heating performance is deteriorated. However, while both the low stage side compressor 11 and the high stage side compressor 21 are continuously operated, heat exchange is performed between the high-pressure side of the high stage side refrigeration circuit 20 and the low-pressure side of the low stage side refrigeration circuit, and thus, the compression ratio of the compressors can be reduced. Accordingly, power consumption can be suppressed.

Therefore, in the present invention, since the dual-stage operation can be continued while minimizing the reduction in COP even when the return temperature of the heating medium is increased, a shift from the dual-stage operation to the single-stage operation in which only the low stage side compressor is operated can be suppressed to the utmost. Accordingly, it is possible to avoid in advance temperature decrease in a space being heated and generation of a sense of insufficiently warmed, which are caused by suspension of the high stage side compressor 21.

INDUSTRIAL APPLICABILITY

The heat pump type heating apparatus according to the present invention is a heat pump type heating apparatus including the low stage side refrigeration circuit and the high stage side refrigeration circuit wherein, even under condition that the high stage side compressor needs to be stopped because the return temperature of the heating medium reaches the prescribed high-temperature threshold, heat exchange is performed, at the second internal heat exchanger, between the high-temperature refrigerant on the high-pressure side of the high stage side refrigeration circuit and the low-temperature refrigerant on the low-pressure side of the low stage side refrigeration circuit. Accordingly, the dual-stage operation can be continued until a higher return temperature of the heating medium is reached. Therefore, even under such condition as to require the dual-stage operation to be shifted to the single-stage operation in a conventional apparatus, the dual-stage operation can be continued, and thereby, deterioration in the sense of being warmed due to stop of the high stage side compressor can be solved. Furthermore, even when the outside air temperature falls within the prescribed frequent defrosting operation temperature range, heat exchange is performed, at the second internal heat exchanger, between the high-temperature refrigerant on the high-pressure side of the high stage side refrigeration circuit and the low-temperature refrigerant on the low-pressure side of the low stage side refrigeration circuit, and thereby, formation of frost in the evaporator can be suppressed and frequent defrosting operation can be avoided.

REFERENCE SIGNS LIST

H heat pump type heating apparatus
1 dual-stage heat pump unit
2 control device (control means, flow path control means)
3 second internal heat exchanger
4 bypass pipe
6, 7 electromagnetic open/close valve (flow path control means)
10 low stage side refrigeration circuit
11 low stage side compressor
12 low stage side heating medium-refrigerant heat exchanger
13 cascade heat exchanger
14 low stage side expansion valve (low stage side decompressing means)
15 evaporator

16 evaporator blower
18 first internal heat exchanger
20 high stage side refrigeration circuit
21 high stage side compressor
22 high stage side heating medium-refrigerant heat exchanger
23 high stage side expansion valve (high stage side decompressing means)
30 heating unit
31 heating terminal
32 heating medium circuit
33 flow rate adjusting valve (flow rate adjusting means)
34 three-way valve (branch flow adjusting means)
36 circulation pump
41 memory
50 outside air temperature sensor
51 low stage side discharge temperature sensor
53 high stage side discharge temperature sensor
54 low stage side outgoing heating-medium temperature sensor (low stage side outgoing heating-medium temperature detecting means)
55 high stage side outgoing heating-medium temperature sensor (high stage side outgoing heating-medium temperature detecting means)
56 outgoing heating-medium temperature sensor (outgoing temperature detecting means)
57 return heating-medium temperature sensor (return heating-medium temperature detecting means)
60 control panel (input means)

The invention claimed is:

1. A heat pump type heating apparatus characterized by comprising:

a dual-stage heat pump unit including a low stage side refrigeration circuit formed by annularly connecting, in order, a low stage side compressor, a low stage side heating medium-refrigerant heat exchanger, a cascade heat exchanger, low stage side decompressing means, and an evaporator, so as to circulate a refrigerant therethrough, and a high stage side refrigeration circuit formed by annularly connecting, in order, a high stage side compressor, a high stage side heating medium-refrigerant heat exchanger, high stage side decompressing means, and the cascade heat exchanger, so as to circulate a refrigerant therethrough; and a heating unit having a heating medium circuit including a circulation pump, a heating terminal, the low stage side heating medium-refrigerant heat exchanger, and the high stage side heating medium-refrigerant heat exchanger, so as to circulate a heating medium therethrough, wherein the heat pump type heating apparatus further includes an internal heat exchanger that performs heat exchange between a low-temperature refrigerant on a low-pressure side of the low stage side refrigeration circuit and a high-temperature refrigerant on a high-pressure side of the high stage side refrigeration circuit, a bypass pipe bypassing the internal heat exchanger, and flow path control means that controls a refrigerant flow to each of the internal heat exchanger and the bypass pipe.

2. The heat pump type heating apparatus according to claim 1, wherein the bypass pipe is provided between a refrigerant flowout side of the high stage side heating medium-refrigerant heat exchanger and a refrigerant inflow side of the high stage side decompressing means in the high stage side refrigeration circuit, or between a refrigerant flowout side of the evaporator and a refrigerant suction side of the low stage side compressor in the low stage side refrigeration circuit.

3. The heat pump type heating apparatus according to claim 1, wherein when, in a dual-stage operation in which the low stage side compressor and the high stage side compressor are operated, a return temperature of a heating medium flowed out of the heating terminal is equal to or higher than a prescribed high-temperature threshold, the flow path control means performs high stage side refrigerant cooling control of causing a refrigerant on the low-pressure side of the low stage side refrigeration circuit or a refrigerant on the high-pressure side of the high stage side refrigeration circuit to flow into the internal heat exchanger side.

4. The heat pump type heating apparatus according to claim 3, wherein the flow path control means performs the high stage side refrigerant cooling control when the outside air temperature is equal to or lower than a prescribed high stage side cooling operation upper limit temperature.

5. The heat pump type heating apparatus according to claim 3, wherein the flow path control means performs the high stage side refrigerant cooling control when the outside air temperature is within a prescribed frequent defrosting operation temperature range.

* * * * *